US005849177A

United States Patent [19]

Nadler et al.

[11] Patent Number: 5,849,177

[45] Date of Patent: Dec. 15, 1998

[54] PROCESS FOR REFORMING A DIMETHYLBUTANE-FREE HYDROCARBON FRACTION

[75] Inventors: Murray Nadler; Jar-lin Kao, both of Houston, Tex.

[73] Assignee: Exxon Chemical Patents Inc., Houston, Tex.

[21] Appl. No.: 371,058

[22] Filed: Jan. 10, 1995

Related U.S. Application Data

[63] Continuation of Ser. No. 6,403, Jan. 21, 1993, abandoned, which is a continuation of Ser. No. 675,113, Mar. 25, 1991, abandoned, which is a continuation of Ser. No. 430,908, Oct. 31, 1989, abandoned, which is a continuation of Ser. No. 175,570, Mar. 31, 1988, abandoned.

[51] Int. Cl.[6] ..... C10G 35/04

[52] U.S. Cl. ..... 208/138; 208/79; 208/80; 208/64; 585/407; 585/418

[58] Field of Search ..... 585/407, 418; 208/79, 80, 64, 138

[56] References Cited

U.S. PATENT DOCUMENTS

| | | | |
|---|---|---|---|
| 2,944,959 | 7/1960 | Kline et al. | 208/79 |
| 3,005,770 | 10/1961 | Lutz | 208/140 |
| 3,018,244 | 1/1962 | Stanford et al. | 208/79 |
| 3,644,200 | 2/1972 | Young | 208/120 |
| 3,697,578 | 10/1972 | Dalson et al. | 208/138 |
| 3,753,891 | 8/1973 | Graven et al. | 208/80 |
| 3,761,392 | 9/1973 | Pollock | 208/80 |
| 3,776,837 | 12/1973 | Dautzenberg | 208/80 |
| 3,783,123 | 1/1974 | Young | 208/111 |
| 4,104,320 | 8/1978 | Bernard et al. | 260/673.5 |
| 4,162,212 | 7/1979 | Miller | 208/79 |
| 4,401,554 | 8/1983 | Choi et al. | 208/64 |
| 4,448,891 | 5/1984 | Cohen | 502/74 |
| 4,456,527 | 6/1984 | Buss et al. | 208/89 |
| 4,594,145 | 6/1986 | Roarty | 208/79 |
| 4,595,668 | 6/1986 | Poeppelmeier et al. | 502/66 |
| 4,636,298 | 1/1987 | Buss et al. | 208/79 |
| 4,645,586 | 2/1987 | Buss | 208/65 |
| 4,747,933 | 5/1988 | Hibbs | 208/79 |
| 4,897,177 | 1/1990 | Nadler | 208/79 |

FOREIGN PATENT DOCUMENTS

| | | |
|---|---|---|
| 0895280 | 3/1972 | Canada . |
| 0 145 289 | 6/1985 | European Pat. Off. . |
| 0303097 | 2/1989 | European Pat. Off. . |
| 2115208 | 7/1972 | France . |
| 2323664 | 4/1977 | France . |
| 0981094 | 1/1965 | United Kingdom . |
| 2 116 450 | 9/1983 | United Kingdom . |

OTHER PUBLICATIONS

"Slective Catalytic Process for Conversion of Light Naphtha to Aromatics", D. V. Law, et al., Energy Process, vol. 7, No. 4, pp. 215–222, Dec., 1987.

"Octaine Enhancement by Selective Reforming of Light Paraffins", P. W. Tamm, et al., pp. 335–353, Catalysis, 1987.

"Aromatization of Hydrocarbons over Platinum Alkaline Earth Zeolites", T. R. Hughes, et al., Proceedings of the 7th International Zeolite Conference, p. 725, Tokyo, Japan, (1986).

Advances in Catalysis, vol. 25, 1976, pp. 150–155.

*Primary Examiner*—Helane Myers
*Attorney, Agent, or Firm*—Edward F. Sherer

[57] ABSTRACT

A process for reforming a hydrocarbon fraction substantially free of dimethylbutanes. The hydrocarbon is separated into a fraction comprising the $C_5$– hydrocarbons and the dimethylbutanes, a light fraction excluding dimethyl butanes, and a heavy fraction. The light fraction is reformed in the presence of a monofunctional catalyst, and the heavy fraction is reformed in the presence of a bifunctional catalyst.

28 Claims, 2 Drawing Sheets

PROCESS FOR REFORMING A DIMETHYLBUTANE-FREE HYDROCARBON FRACTION

This is a continuation of application Ser. No. 08/006,403 filed Jan. 21, 1993, now abandoned, which is a continuation of U.S. patent application Ser. No. 07/675,113, filed Mar. 25, 1991 now abandoned, which is a continuation of U.S. Ser. No. 07/430,908 filed Oct. 31, 1989, now abandoned, which is a continuation of U.S. Ser. No. 07/175,570 filed Mar. 31, 1988, now abandoned, the disclosures of which in their entireties are incorporated herein by reference.

BACKGROUND OF THE INVENTION

1. Field of the Invention

The process of this invention provides for reforming of a hydrocarbon stream substantially free of dimethylbutanes. The improved process is beneficial for any of several purposes, including the upgrading of motor gas (mogas) pools, or enhancing the yield of aromatic compounds in petrochemical operations.

2. Description of Material Information

Hydrocarbons can be subjected to a variety of processes, depending upon the product or products desired, and their intended purposes. A particularly significant process for treating hydrocarbons is that of reforming.

In hydrocarbon conversion, the reforming process is generally applied to fractions in the $C_6$–$C_{11}$ range. The light fractions are unsuitable because they crack to lighter gases at reforming conditions; the heavier fractions cause higher coking rates (deposition of carbon on the catalyst), and therefore accelerate deactivation of the catalyst.

A variety of reactions occur as part of the reforming process. Among such reactions are dehydrogenation, isomerization, and hydrocracking. The dehydrogenation reactions typically include dehydroisomerization of alkylcyclopentanes to aromatics, dehydrogenation of paraffins to olefins, dehydrogenation of cyclohexanes to aromatics, and dehydrocyclization of paraffins and olefins to aromatics. Reforming processes are especially useful in refinery operations for upgrading mogas pool octane value, and in petrochemical operations for enhancing aromatics yield, as well as producing hydrogen.

Different types of catalysts are used for conducting the reforming of hydrocarbon streams. One means of categorizing the type of catalysts so used is by designating them as "monofunctional" and "bifunctional" catalysts.

Monofunctional catalysts are those which accomplish all of the reforming reactions on one type of site—usually, a catalytically active metal site. These catalysts are monofunctional by virtue of lacking an acidic site for catalytic activity.

Examples of monofunctional catalysts include the large pore zeolites, such as zeolites L, Y, and X and the naturally occurring faujasite and mordenite, wherein the exchangeable cation comprises a metal such as alkali or alkaline earth metal; such catalysts also comprise one or more Group VIII metals providing the catalytically active metal sites, with platinum being a preferred Group VIII metal. Exchange of the metallic exchangeable cation of the zeolite crystal with hydrogen will provide acidic sites, thereby rendering the catalyst bifunctional.

A bifunctional catalyst is rendered bifunctional by virtue of including acidic sites for catalytic reactions, in addition to catalytically active metal sites. Included among conventional bifunctional reforming catalysts are those which comprise metal oxide support acidified by a halogen, such as chloride, and a Group VIII metal. A preferred metal oxide is alumina, and a preferred Group VIII metal is platinum.

The suitability of monofunctional and bifunctional catalysts for reforming varies according to the hydrocarbon number range of the fraction being subjected to catalyzation.

Both bifunctional and monofunctional catalysts are equally well suited for reforming the naphthenes, or saturated cycloalkanes.

Monofunctional catalysts are particularly suited for reforming the $C_6$–$C_8$ hydrocarbons, and bifunctional catalysts are better suited than monofunctional catalysts for reforming the $C_9$+ hydrocarbons. It has been discovered that the presence of about 10 percent by volume or greater $C_9$+ content in a hydrocarbon fraction significantly inhibits catalytic activity in monofunctional catalysts; this discovery is the subject of a concurrently filed application, Ser. No. 07/171,993, now U.S. Pat. No. 4,897,177 entitled PROCESS FOR REFORMING A HYDROCARBON FRACTION WITH A LIMITED $C_9$+ CONTENT, Attorney's Docket No. P5868; this application is incorporated herein in its entirety by reference thereto.

It is known in the art to employ split feed reforming processes, wherein fractions of different hydrocarbon number range are separated out of a hydrocarbon feed, and subjected to different reforming catalysts. U.S. Pat. No. 4,594,145 discloses a process wherein a hydrocarbon feed is fractionated into a $C_5$− fraction and a $C_6$+ fraction; in turn, the $C_6$+ fraction is fractionated into a $C_6$ fraction containing at least ten percent by volume of $C_7$+ hydrocarbons, and a $C_7$+ fraction. The $C_6$ fraction is subjected to catalytic reforming; the catalyst employed is most broadly disclosed as comprising a Group VIII noble metal and a non-acidic carrier, with the preferred embodiment being platinum on potassium type L zeolite, which is monofunctional. The catalyst utilized with the $C_7$+ fraction is bifunctional, being most broadly disclosed as comprising platinum on an acidic alumina carrier.

The Example set forth in that patent discloses, at column 6, lines 50–52, a $C_5$− fraction containing, in addition to these $C_5$− hydrocarbons, a proportion of 6 percent $C_6$ hydrocarbons. However, there is no teaching as to which $C_6$ isomers are included in the $C_6$ component of this $C_5$− fraction, or as to the proportion of dimethylbutanes from the original feed remaining with the $C_6$+ fraction after the first fractionation. There is further no teaching of splitting dimethylbutanes along with the $C_5$− fraction away from the streams to be reformed, or providing fractions which essentially exclude dimethylbutanes, or contain only minor proportions thereof, to the reforming catalysts.

As previously indicated, the monofunctional catalysts are particularly suited for reforming the $C_6$–$C_8$ hydrocarbons. However, it has been discovered that the presence of dimethylbutanes, the lowest-boiling of the $C_6$ isomers, in the hydrocarbon fraction treated over monofunctional catalyst, is commercially disadvantageous for two reasons.

As one reason, because of the reaction mechanism associated with monofunctional catalysts, monofunctional catalysts are not facile for dehydrocyclizing dimethylbutanes to benzene. Instead, such catalysts crack a large portion of the dimethylbutanes to undesirable light gases.

As the second reason, dimethylbutanes have the highest octane rating among the non-aromatic $C_6$ hydrocarbons, and are therefore of the most value in the mogas pool. Subjecting dimethylbutanes to catalytic activity renders them unavailable for upgrading the value of the mogas pool to the extent that they are cracked.

In the process of this invention, dimethylbutanes are removed from a hydrocarbons stream prior to reforming. The inventive process therefore provides benefits not taught or disclosed in the prior art.

Definition of Terms

As used herein in the context of hydrocarbon or naphtha feeds, the terms "light fraction" and "heavy fraction" define the carbon number range of the hydrocarbons comprising the indicated fraction. These terms are used in a relative manner; a "heavy fraction" is defined in reference to the carbon number range of its corresponding "light" fraction, and visa versa.

Specifically, a "light" fraction is a $C_6$ fraction, a $C_7$ fraction, a $C_8$ fraction, a $C_6$–$C_7$ fraction, a $C_7$–$C_8$ fraction, a $C_6$–$C_8$ fraction, or a fraction consisting essentially of $C_6$ and $C_8$ hydrocarbons. Further, it is understood that, unless otherwise indicated, a light fraction comprises not more than about 10%, preferably not more than about 3%, more preferably not more than about 0.1%, and, most preferably, 0%, or essentially 0% by volume dimethylbutanes.

Yet further, a light fraction preferably comprises no more than about 10%, and, most preferably, no more than about 2% by volume $C_5$− hydrocarbons. Also, a light fraction preferably comprises no more than about 5%, and, more preferably, about 2% by volume $C_9$+ hydrocarbons.

A "heavy" fraction comprises a range of hydrocarbons wherein the lowest carbon number compound is one carbon number higher than the highest carbon number compound of the corresponding light fraction.

Accordingly, when the light fraction is $C_6$, the corresponding heavy fraction is $C_7$+. When the light fraction is $C_6$–$C_7$ or $C_7$, the corresponding heavy fraction is $C_8$+. When the light fraction is $C_8$, $C_7$–$C_8$, $C_6$–$C_8$, or a fraction consisting essentially of $C_6$ and $C_8$ hydrocarbons, the corresponding heavy fraction is $C_9$+.

Unless specifically stated otherwise, the $C_5$− fraction is understood to include the $C_6$ dimethylbutane isomers.

It is further understood that particular fractions are not necessarily comprised exclusively of hydrocarbons within the indicated carbon number range of the fraction. Other hydrocarbons may also be present. Accordingly, a fraction of particular carbon number range may contain up to 15 percent by volume of hydrocarbons outside the designated hydrocarbon number range. A particular hydrocarbon fraction preferably contains not more than about 5%, and, most preferably, not more than about 3% by volume, of hydrocarbons outside the designated hydrocarbon range.

In this context, it is understood, unless stated otherwise, that hydrocarbon fractions which are subjected to reforming contain not more than about 10%, preferably not more than about 3%, more preferably not more than about 0.1%, and, most preferably, 0%, or essentially 0% by volume dimethylbutanes. Particularly, dimethylbutanes comprise not more than about 5–10% by volume of light fractions, and, typically, less than 3% by volume of light fractions.

Similarly, as previously stated, it is understood that light fractions preferably contain not more than about 10%, and, most preferably, not more than about 2% by volume of $C_5$− hydrocarbons; light fractions preferably also contain not more than about 10%, and, most preferably, not more than about 3% by volume of $C_9$+ hydrocarbons.

Yet further, it is understood that at least about 75%, preferably about 90%, and, most preferably, about 95% by volume of the proportion of dimethylbutanes present in the hydrocarbon feed are separated out with the first fraction when the hydrocarbon feed is separated into first and second fractions prior to the reforming steps. In fact, the separation of the first and second fractions is effected so that as much as 90–98% by volume, and even up to essentially 100% by volume of such dimethylbutanes are so separated, while much of the heavier $C_6$ content of the hydrocarbon feed is included with the second fraction.

Correspondingly, the second fraction comprises not more than about 3%, preferably about 1%, and, most preferably, 0%, or about 0% by volume of dimethylbutanes.

SUMMARY OF THE INVENTION

The invention pertains to a reforming process in which a hydrocarbon fraction comprising not more than about 10% by volume dimethylbutanes is reformed. This hydrocarbon fraction preferably comprises not more than about 3%, more preferably, not more than 0.1%, and, most preferably, 0%, or essentially 0% by volume of dimethylbutanes.

Preferably, this hydrocarbon fraction is a $C_6$ fraction, a $C_7$ fraction, a $C_8$ fraction, a $C_6$–$C_7$ fraction, a $C_7$–$C_8$ fraction, a $C_6$–$C_8$ fraction, or a fraction consisting essentially of $C_6$ and $C_8$ hydrocarbons.

The process can take place under reforming conditions, in the presence of a monofunctional catalyst. Preferably this catalyst comprises a large-pore zeolite and at least one Group VIII metal.

A suitable large-pore zeolite is zeolite L, and the Group VIII metal may be platinum. The monofunctional catalyst may further comprise an alkaline earth metal; preferred alkaline earth metals include magnesium, barium, strontium, and calcium.

The invention further pertains to a process for reforming a hydrocarbon feed, which is preferably a $C_5$–$C_{11}$ hydrocarbon fraction. In the process of the invention, the hydrocarbon feed is separated into a first fraction and a second fraction, with the first fraction containing at least about 75% by volume of the proportion of dimethylbutanes present in the hydrocarbon feed. The second fraction preferably comprises not more than about 1%, and, most preferably, essentially 0% by volume dimethylbutanes. At least a portion of the second fraction is subjected to reforming in the presence of a reforming catalyst.

After separation of the hydrocarbon feed into these first and second fractions, the second fraction is separated into a light fraction and a heavy fraction. The light fraction comprises, by volume, not more than about 10%, preferably not more than about 3%, more preferably not more than about 0.1%, and, most preferably, no, or essentially no dimethylbutanes. The heavy fraction comprises a range of hydrocarbons wherein the lowest carbon number hydrocarbon is one carbon number higher than the highest carbon number hydrocarbon of the light fraction. After separation of the second fraction into these light and heavy fractions, the light fraction is reformed, under reforming conditions, in the presence of a monofunctional catalyst.

In one embodiment, the first fraction comprises $C_5$− hydrocarbons and dimethylbutanes, and the second fraction is a $C_6$+ fraction. In this embodiment, the light fraction may be a $C_6$ fraction, a $C_7$ fraction, a $C_8$ fraction, a $C_6$–$C_7$ fraction, a $C_7$–$C_8$ fraction, a $C_6$–$C_8$ fraction, or a fraction consisting essentially of $C_6$ and $C_8$ hydrocarbons; preferably, the light fraction in this embodiment is $C_6$–$C_8$ fraction.

In another embodiment of the process of the present invention, the first fraction may be a $C_6$− fraction, and the second fraction a $C_7$+ fraction; In the separation of the second fraction of this embodiment into light and heavy fractions, the light fraction may be a $C_7$ fraction, a $C_8$ fraction, or a $C_7$–$C_8$ fraction. In this embodiment, the light fraction is preferably a $C_7$–$C_8$ fraction.

The monofunctional catalyst of the process of the invention preferably comprises a large-pore zeolite and at least one Group VIII metal. Preferably, the large-pore zeolite is Zeolite L, and the Group VIII metal of the monofunctional catalyst is platinum. The monofunctional catalyst may further comprise an alkaline earth metal selected from the group consisting of calcium, barium, magnesium, and strontium.

The indicated heavy fraction may also be reformed under reforming conditions; preferably, this reforming takes place in the presence of a bifunctional catalyst. Preferably, this bifunctional catalyst comprises a Group VIII metal, and a metal oxide support provided with acidic sites. The preferred metal oxide support is alumina, and the preferred Group VIII metal of the bifunctional catalyst is platinum. The bifunctional catalyst may further comprise at least one promoter metal selected from the group consisting of rhenium, tin, germanium, iridium, tungsten, cobalt, rhodium, and nickel.

DESCRIPTION OF THE PREFERRED EMBODIMENTS

Figure 1:
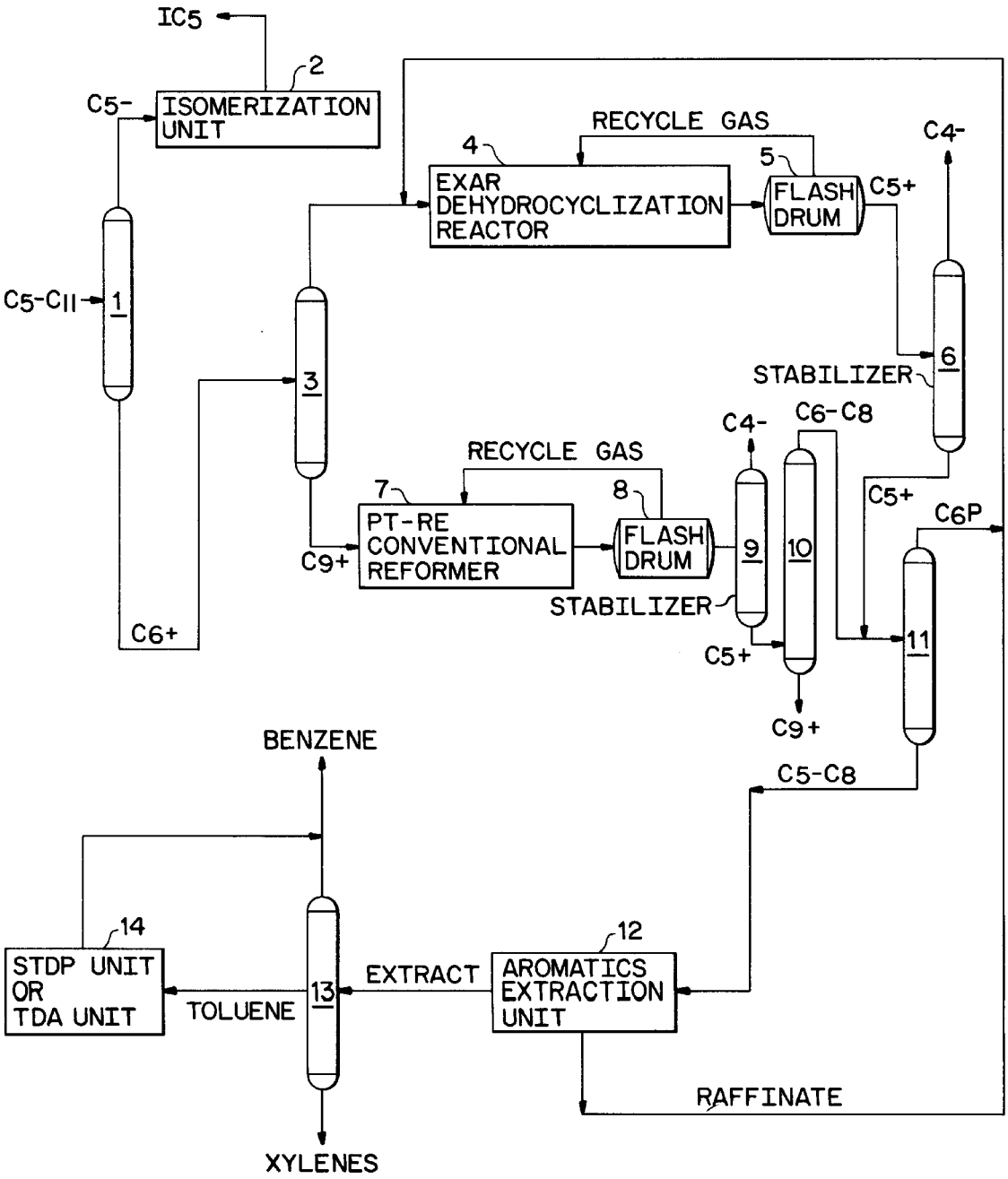
FIG. 1 is a schematic representation of the process of the invention as adapted for petrochemical operations.

The catalyst employed in reforming of the hydrocarbon light fraction is a monofunctional catalyst, providing a single type of reactive site for catalyzing the reforming process.

Preferably, this monofunctional catalyst comprises a large-pore zeolite charged with one or more Group VIII metals, e.g. platinum, palladium, iridium, ruthenium, rhodium, osmium, or nickel. The preferred of these metals are the Group VIII noble metals, including rhodium, iridium, and, platinum. The most preferred such metal is platinum.

Large-pore zeolites, as referred to herein, are defined as zeolites having an effective pore diameter of about 6–15 Angstroms. Among the large-pore zeolites suitable for the monofunctional catalysts are zeolite X, zeolite Y, and zeolite L, as well as such naturally occuring zeolites as faujasite and mordenite. The most preferred large-pore zeolite is zeolite L.

The exchangeable cation of the large-pore zeolite may be one or more metals selected from the group consisting of alkali metals and alkaline earth metals; the preferred alkali metal is potassium. Preferably, the exchangeable cation comprises one or more alkali metals which can be partially or substantially fully exchanged with one or more alkaline earth metals; the preferred such alkaline earth metals are barium, strontium, magnesium, and calcium. Cation exchange may also be effected with zinc, nickel, manganese, cobalt, copper, lead, and cesium.

The most preferred of such alkaline earth metals is barium. In addition to, or other than by ion exchange, the alkaline earth metal can be incorporated into the zeolite by synthesis or impregnation.

The monofunctional catalyst may further comprise one or more of an inorganic oxide, which may be utilized as a carrier to bind the large-pore zeolite containing the Group VIII metal. Suitable such inorganic oxides include clays, alumina, and silica, the most preferred being alumina.

Included among the monofunctional catalysts suitable for use in the process of this invention are those disclosed in U.S. Pat. Nos. 4,595,668, 4,645,586, 4,636,298, 4,594,145, and 4,104,320. The disclosures of all these patents are incorporated herein in their entirety, by reference thereto.

The bifunctional catalyst of the inventive process is a conventional reforming catalyst, comprising a metal oxide support provided with acidic sites, and a Group VIII metal. Suitable metal oxides include alumina and silica, with alumina being preferred. The acidic sites are preferably provided by the presence of a halogen, such as chlorine.

The preferred Group VIII metal is platinum. One or more additional promoter elements, such as rhenium, tin, germanium, cobalt, nickel, iridium, rhodium, ruthenium, may also be included.

Each of the monofunctional and bifunctional catalysts is utilized under reforming conditions conventional for the particular catalyst. Reformation with either or both of the catalysts is carried out in the presence of hydrogen.

As previously discussed, the inclusion of dimethylbutanes in the light fraction is commercially disadvantageous for two reasons, one particularly relevant to petroleum refining operations, the other applying to reforming processes in general. As the first reason, dimethylbutanes have the highest octane rating of any $C_6$ isomer, and therefore have the most value for the purpose of upgrading the mogas pool. As a second reason, subjecting the dimethylbutanes to the monofunctional catalyst will result in the cracking of a large portion of these isomers to less valuable light gases.

This second reason is illustrated by the data set forth in Table I below.

Table I comparatively illustrates yields obtained from subjecting a feed mixture of n-hexane, 3-methyl pentane, and methyl cyclopentane and a feed of 2,3-dimethylbutane to reforming conditions over a monofunctional catalyst comprising Zeolite-L with alumina binder and platinum (0.6 wt %). Both of these $C_6$ isomers were reacted over monofunctional catalyst at a temperature of 950° F., under 100 psig $H_2$ partial pressure, at a space velocity of 2.5 WHSV, and a $H_2$/oil molar ratio of 6.0.

TABLE I

| Feed<br>Products, wt % on Feed | A feed mixture of<br>60 wt % n-hexane<br>30 wt % 3-methyl pentane<br>10 wt % methyl cyclopentane | 2.2-dimethyl butane |
|---|---|---|
| $C_1$ Methane | 5.3 | 29.5 |
| $C_2$ Ethane | 3.8 | 14.2 |
| $C_3$ Propane | 4.4 | 21.1 |
| $IC_4$ iso-Butane | 0.9 | 8.7 |
| $NC_4$ n-Butane | 3.8 | 7.9 |
| $IC_5$ iso-Pentane | 3.0 | 4.9 |
| $NC_5$ n-Pentane | 6.3 | 1.1 |
| CP Cyclopentane | 0.0 | 0.0 |
| DMB Dimethyl Butanes | 0.2 | 0.7 |
| $IC_6$ iso-Hexanes | 3.9 | 0.2 |
| $NC_6$ n-Hexanes | 1.1 | 0.1 |
| MCP Methyl Cyclopentane | 0.0 | 0.0 |
| CH Cyclohexane | 0.0 | 0.0 |
| BZ Benzene | 64.5 | 10.8 |
| TOL Toluene | 0.4 | 0.4 |
| $A_8$ Xylenes | 0.2 | 0.1 |
| $A_9$+ $C_9$+ Aromatics | 1.8 | 0.2 |

The data set forth in Table I demonstrate the extreme difference in product proportions for a feed comprising n-hexane, 3-methyl pentane and methyl cyclopentane and a feed of 2,3-dimethyl butane reformed over the indicated monofunctional catalyst. Particularly significant in the product differences is the much lower proportion of benzene resulting from reforming of 2,3-dimethyl butane higher cracked products, and less hydrogen.

Figure 2:
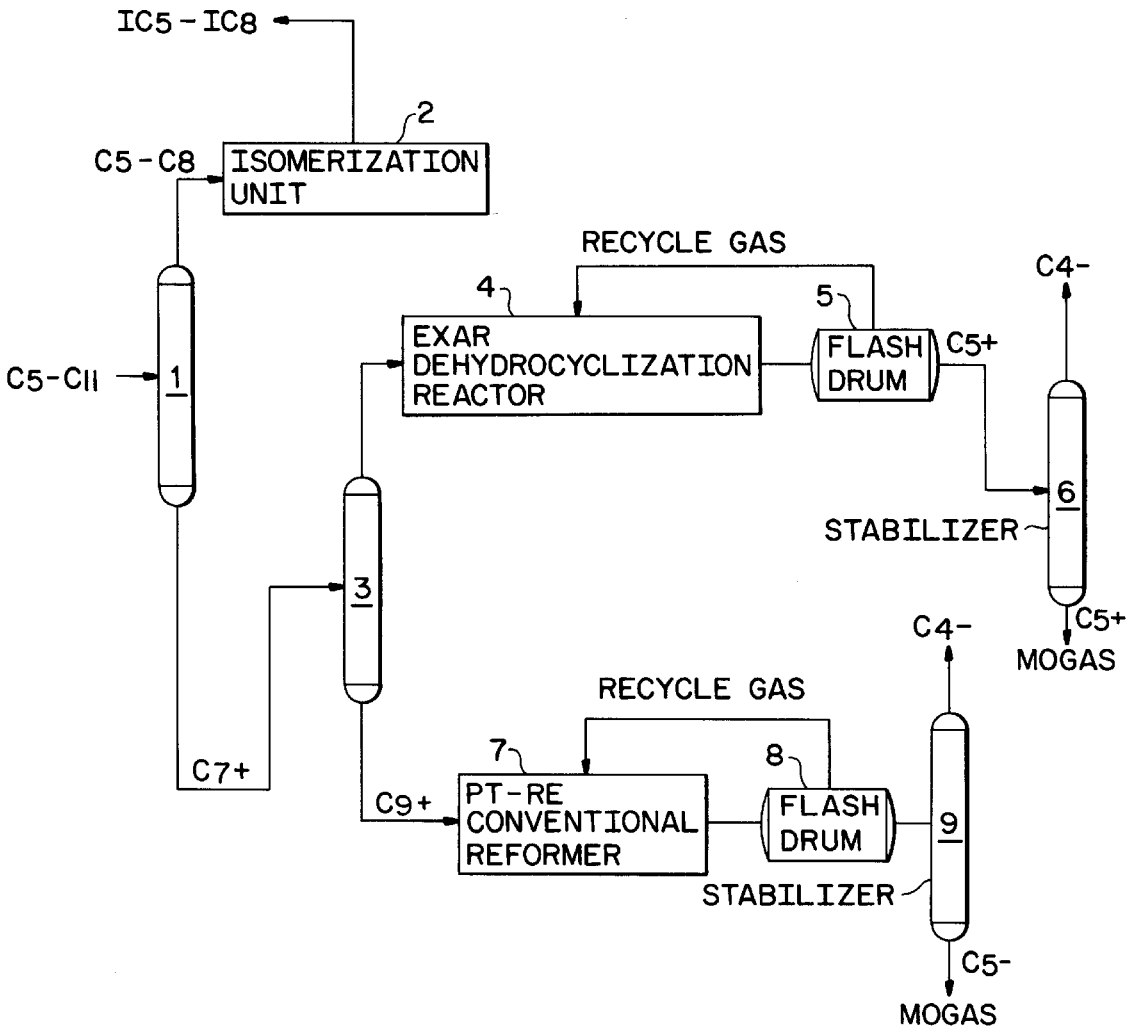
FIG. 2 is a schematic representation of the process of the invention as adapted for-refinery operations.

FIGS. 1 and 2, discussed below, illustrate the utilization of the process of the invention in petrochemical and refinery operations, respectively. It is noted that these two embodiments are provided merely by way of example, not limitation, and demonstrate two particular methods for utilizing the process of the invention.

EXAMPLE 1

This Example, which demonstrates the application of the process of the invention to petrochemical operations, is described with reference to the flow diagram of FIG. 1, and the various hydrocarbon streams and units identified therein. Unless otherwise specifically stated, the percent proportions herein are by volume.

A crude oil stream is subjected to rough separation in a pipe still (not shown) to produce a naphtha feed stream, which is fed from the pipe still directly into distillation tower 1. The naphtha feed stream comprises a $C_5$–$C_{11}$ fraction of hydrocarbons, and contains 50% paraffins, 33% naphthenes, and 17% aromatics.

Distillation tower 1 is a 50 tray distillation tower. The condenser, provided at the top of the tower, is operated at 120° F. and 45 psia, with a reflux ratio of about 0.8. The reboiler, provided at the bottom of distillation tower 1, is operated at 290° F., and at a pressure of 55 psia.

In distillation tower 1, this $C_5$–$C_{11}$ fraction is separated into a $C_5$− fraction and a $C_6$+ fraction. The $C_5$− fraction contains 14% $C_6$ hydrocarbons, with the remainder being $C_5$− hydrocarbons. 10% of the $C_6$ hydrocarbons are dimethylbutanes; the dimethylbutanes which split off with the $C_5$− hydrocarbons in this fraction comprise 85% of the dimethylbutanes present in the $C_5$–$C_{11}$ fraction prior to this separation.

This $C_5$− fraction, including the indicated $C_6$ portion, is removed overhead from distillation tower 1. This fraction may be blended directly into the mogas pool. Alternatively, this fraction may be sent to isomerization unit 2, wherein its octane value is upgraded, and may thereafter be sent to the mogas pool.

The $C_6$+ fraction from distillation tower is fed into distillation tower 3, which comprises 50 trays. The condenser, at the top of the tower, is operated at 190° F., at a pressure of 25 psia, and a reflux ratio of 2.5. The reboiler, at the bottom of the tower, is operated at 320° F. and 35 psia.

In distillation tower 3, the $C_6$+ fraction is separated into a $C_6$–$C_8$ fraction and a $C_9$+ fraction. Because, as discussed previously herein, excessive $C_9$+ content interferes with the activity of the monofunctional catalyst, a sharp cut is made between the $C_8$ and $C_9$ hydrocarbons.

The resultant $C_6$–$C_8$ fraction contains 1% $C_5$− hydrocarbons, 28% $C_6$ hydrocarbons, 32% $C_7$ hydrocarbons, 35% $C_8$ hydrocarbons, and 4% $C_9$+ hydrocarbons; the $C_9$+ fraction contains 9% $C_8$− hydrocarbons, 48% $C_7$–$C_9$ hydrocarbons, 29% $C_{10}$ hydrocarbons, and 14% $C_{11}$ hydrocarbons.

The $C_6$–$C_8$ fraction taken overhead from tower 3 is fed into reactor 4, which contains the monofunctional reforming catalyst. The catalyst comprises potassium zeolite L, with 28% by weight alumina binder and 0.6% by weight platinum. Reforming is conducted in the presence of hydrogen gas; reactor 4 is operated at 850°–900° F., 1.5 WHSV, 160 psig, and a hydrogen to hydrocarbon mole ratio of 4. The product which results from this reforming contains 10% benzene, 14% toluene, 16% xylenes, 38% $C_5$–$C_8$ paraffins and naphthenes and the remainder light gases and hydrogen.

The effluent from reactor 4 is fed into flash drum 5, operated at 110° F. and approximately 115 psig. Therein, a crude separation between $C_4$− light gases and a $C_5$+ fraction, with the $C_5$+ fraction retaining about 2% of the $C_4$− fraction, and further containing 98% or more of the effluent aromatics.

A stream including the $C_4$− fraction and hydrogen from flash drum 5 is recycled as needed to reactor 4; the excess of this stream is removed from the process system, with by-products being recovered therefrom.

The $C_5$+ effluent from flash drum 5 is then fed into distillation tower 6. Distillation tower 6, comprising 30 trays, functions as a reformate stabilizer. The condenser is operated at 190° F. and 100 psia; the reboiler, at 300° F. and 105 psia.

As opposed to the crude separation conducted in flash drum 5, a sharp cut 6 is effected in distillation tower 6 between the $C_4$− and $C_5$+ fractions. The resultant $C_5$+ fraction contains, by volume, 2% $C_5$− hydrocarbons, 17% benzene, 22% toluene, 27% xylenes, and 32% $C_6$–$C_8$ paraffins and naphthenes.

The $C_9$+ fraction from distillation tower 3 is fed into conventional reformer 7, which contains a bifunctional catalyst comprising, by weight, 0.3% platinum, 0.3% rhenium, 0.8% chlorine, and 98.6% alumina. Reformer 7 is operated at 850°–980° F., 1.5 WHSV, 300 psig, and a recycled gas rate of 2.0 kSCFH/Bbl of feed. As in reformer 4, reforming is conducted in the presence of hydrogen.

Reformer 7 is operated at conditions predetermined to result in a product having an octane of 103. This product contains, by volume, 18% hydrogen, 21% $C_5$− hydrocarbons, 1% benzene, 3% other $C_6$ hydrocarbons (excluding benzene), 1% toluene, 2% other $C_7$ hydrocarbons, 9% xylenes, 3% other $C_8$ hydrocarbons, 39% $C_9$+ aromatics, and 3% other $C_9$+ hydrocarbons.

This product is fed as effluent to flash drum 8 and distillation tower 9, which-operate in the same manner with regard to reformer 7 as flash drum 5 and distillation tower 6 perform with reactor 4. In flash drum 8, a crude separation is effected between the $C_4$− light gases and a $C_5$+ effluent; after this crude separation, the $C_5$+ effluent retains about 2% of the $C_4$− hydrocarbons. The $C_4$− fraction thus separated is recycled with hydrogen, as needed, to reformer 7, with excess removed from the process system for recovery of valuable by-products. The $C_5$+ effluent is fed from flash drum 8 into distillation tower 9, which comprises 30 trays. The condenser, in the top section of this tower, is operated at 190° F. and 100 psia; the reboiler, in the bottom section, is operated at 300° F. and 105 psia.

Distillation tower 9, like distillation tower 6, functions as a reformate stabilizer; in tower 9, a sharp cut is effected between the $C_5$+ effluent and the $C_4$− fraction remaining therein. The resultant $C_5$+ fraction contains, by volume, 2% $C_4$− hydrocarbons, 6% $C_5$ hydrocarbons, 4% $C_6$ hydrocarbons (excluding benzene), 1% benzene, 3% $C_7$ hydrocarbons (excluding toluene), 2% toluene, 14% xylenes, 5% other $C_8$ hydrocarbons, 4% other $C_9$ hydrocarbon, 38% $C_9$ aromatics, 1% $C_{10}$+ hydrocarbons (excluding aromatics), and 20% $C_{10}$+ aromatics.

As discussed with regard to Example 2, at this point in a refining operation, the $C_5$+ effluent from stabilizer 9 can be sent directly to the mogas pool. However, Example 1 pertains to petrochemical operations, wherein the objective is to maximize aromatics production.

Accordingly, the $C_5$+ effluent from distillation tower 9 is fed to distillation tower 10, which comprises 30 trays. The top section of the this tower, the condenser, is operated at 260° F., and 30 psia; the bottom, the reboiler, at 430° F. and 50 psia.

In distillation tower 10, this $C_5$+ effluent is separated into a $C_6$–$C_8$ fraction, which comprises substantially all of the desirable light aromatic components of the $C_5$+ effluent, and a $C_9$+ fraction. Specifically, the indicated $C_6$–$C_8$ fraction comprises, by volume, 1% benzene, 26% toluene, 44% xylene, 2% $C_9$+ aromatics, and 27% $C_6$–$C_{10}$+ non-aromatic hydrocarbons. The $C_9$+ fraction comprises 1% xylenes, 64% $C_9$ aromatics, 34% $C_{10}$+ aromatics, and 1% other $C_9$ hydrocarbons.

This $C_9$+ fraction is sent directly to the mogas pool for blending, and the $C_6$–$C_8$ fraction is combined with the $C_5$+ effluent from distillation tower 6.

This combined stream can be fed directly to aromatics extraction unit 12. More preferably, it is fed to distillation tower 11, comprising 25 trays. The condenser, in the upper section of tower 11, is operated at 200° F. and 30 psia. the reboiler, in the lower section, is operated at 300° F. and 35 psia.

Distillation tower 11 is employed to remove the $C_6$ paraffins from the feed to be provided to aromatics extraction unit 12, thereby concentrating the aromatics in this feed. Specifically, in distillation tower 11, a $C_6$ paraffin and naphthene fraction, comprising, by volume, 1% dimethylbutane, 39% 2-methyl pentane, 51% 3-methyl pentane, 3% cyclohexane, and 6% methyl cyclopentane is separated from a higher-boiling fraction, comprising benzene through the $C_8$ hydrocarbons.

The $C_6$ fraction from distillation tower 11 is particularly suitable as a feed for monofunctional catalyst reactor 4, and is recycled to this reactor. The fraction comprising benzene through $C_8$ hydrocarbons, which largely comprises aromatics, is fed to aromatics extraction unit 12.

Aromatics extraction unit 12 utilizes a solvent selective for aromatics, such as sulfolane, to extract the aromatics from the non-aromatics, the latter being primarily paraffins. The resulting non-aromatic raffinate is recycled to the feed entering monofunctional catalyst reactor 4, thereby enhancing aromatics yield.

The aromatic extract from aromatics extraction unit 12 is fed to distillation tower 13, and separated therein into benzene, toluene and xylenes. Distillation tower 13 may be a single tower, or a series of towers, depending upon the purity of the products desired.

As a single tower, distillation tower 13 comprises 40 trays. The condenser, at the top of the tower, is operated at 195° F. and 20 psia; benzene issues from the top of the tower. Toluene issues from the tower as a side stream at tray 21, which is operated at 255° F. and 25 psia. Xylene issues from the bottom of the tower, where the reboiler is located, and which is operated at 305° F. and 30 psia.

Where distillation tower 13 is embodied as two towers in series, benzene issues from the top of the first tower in the series, and a mixture of toluene and xylenes issues from the bottom. This mixture is fed into the second tower in the series, with toluene taken off from the top of this tower, and xylenes from the bottom.

The first tower in this series comprises 22 trays, with the condenser, at the top of the tower, being operated at 195° F. and 20 psia, and the reboiler, at the bottom of the tower, being operated at 275° F. and 25 psia. The second tower comprises 20 trays, with the top of the tower being operated at 232° F. and 15 psia, and the bottom being operated at 285° F. and 25 psia.

As an optional preferred embodiment, to maximize the production of aromatics, especially benzene, the toluene stream from distillation tower 13 may be fed to unit 14, which is either a toluene hydrodealkylation (TDA) unit, or a toluene disproportionation (TDP) unit. The TDA unit produces 80% benzene and 20% light gases, i.e., methane and ethane. The TDP unit produces 50% benzene and 50% xylenes, primarily paraxylenes. The benzene produced in these units is fed into the benzene stream exiting overhead from distillation tower 13.

EXAMPLE 2

Example 2, which demonstrates the application of the process of the invention to the enhancement of mogas octane pools in refinery operations, is described with reference to the flow diagram of FIG. 2, and the various hydrocarbon streams and units identified therein. The embodiment illustrated in FIG. 2 is substantially similar to that illustrated in FIG. 1. The primary difference is that the process used for enhancing mogas production is considerably simplified over that for maximizing aromatics yield; the former process lacks the aromatics extraction steps, which are included in the process solely for the purpose of maximizing the referred-to aromatics yield.

One difference between the two embodiments of the process is the cut point utilized in distillation tower 1. In refinery mogas octane pool operations, the production of excessive benzene in the monofunctional catalyst reactor can be undesirable due to benzene concentration restrictions on mogas. Accordingly, as shown in FIG. 2, the cut point in distillation tower 1 is raised, so that not only the dimethylbutanes, but a substantial portion of the other $C_6$ isomers, are sent overhead as well.

Specifically, the overhead stream comprises, by volume, 3% n-butane, 9% i-butane, 17% n-pentane, 16% i-pentane, 1% cyclopentane, 17% n-hexane, 2% dimethyl butanes, 10% 2-methyl pentane, 8% 3-methyl pentane, 6% methyl cyclopentane, 5% cyclohexane, 5% benzene, and 1% $C_9$ isomers. This stream is sent either directly to the mogas pool, or to isomerization unit 2.

Accordingly, the bottoms stream from distillation tower 1 comprises primarily the $C_7$+ hydrocarbons; specifically, this fraction comprises, by volume, 1% $C_6$– hydrocarbons, 25% $C_7$ hydrocarbons, 31% $C_8$ hydrocarbons, 25% $C_9$ hydrocarbons, 13% $C_{10}$ hydrocarbons, 5% $C_{11}$+ hydrocarbons.

Rather than the $C_6$–$C_8$ light fraction fed to monofunctional catalyst reactor 4 in the embodiment of FIG. 1, the light fraction resulting from distillation tower 3 in the embodiment of the FIG. 2 is a $C_7$–$C_8$ fraction. Specifically, this fraction comprises, by volume, 2% $C_6$– hydrocarbons, 44% $C_7$ hydrocarbons, 49% $C_8$ hydrocarbons, and 5% $C_9$+ hydrocarbons.

Processing units 4–9 are identical for the embodiments of both FIGS. 1 and 2. However, in the refinery operation of FIG. 2, the $C_5$+ effluent from distillation towers 6 and 9 is sent directly to the mogas pool, rather than to the aromatics extraction steps specified in the petrochemical operation illustrated in FIG. 1.

Finally, although the invention has been described with reference to particular means, materials, and embodiments, it should be noted that the invention is not limited to the particulars disclosed, and extends to all equivalents within the scope of the claims.

What is claimed is:

1. A process for reforming a hydrocarbon feed comprising:

(a) separating said hydrocarbon feed into a plurality of fractions comprising:

(i) a first fraction comprising $C_5$–hydrocarbons and dimethylbutanes;

ii) a light fraction more than about 10% by volume dimethylbutanes; said light fraction being selected from the group consisting of a $C_6$–fraction, a $C_6$–$C_7$ fraction, a $C_7$ fraction, a $C_8$ fraction, a $C_7$–$C_8$ fraction, and a $C_6$–$C_8$ fraction; and a heavy fraction; and (b) reforming said light fraction under reforming conditions in the presence of a monofunctional, large pore zeolite catalyst.

2. The process as claimed in claim 1, further comprising:

(c) reforming said heavy fraction under reforming conditions in the presence of a bifunctional catalyst.

3. The process as claimed in claim 2, wherein said large-pore zeolite is zeolite L.

4. The process as claimed in claim 1, wherein said amount of dimethylbutanes in said first fraction of said hydrocarbon feed is greater than about 75% of the initial amount of dimethylbutanes in said hydrocarbon feed.

5. The process as claimed in claim 4, wherein said amount of dimethylbutanes in said first fraction of said hydrocarbon feed is greater than about 90% of the initial amount of dimethylbutanes in said hydrocarbon feed.

6. The process as claimed in claim 5, wherein said amount of dimethylbutanes in said first fraction of said hydrocarbon feed is greater than about 95% of the initial amount of dimethylbutanes in said hydrocarbon feed.

7. The process as claimed in claim 1, wherein said hydrocarbon feed is a $C_6$ to $C_{11}$ fraction.

8. The process as claimed in claim 1, wherein said light fraction contains no more than about 3% by volume dimethylbutanes.

9. The process as claimed in claim 8, wherein said light fraction contains no more than about 1% by volume dimethylbutanes.

10. The process as claimed in claim 8, wherein said light fraction contains no more than about 0.1% by volume dimethylbutanes.

11. The process as claimed in claim 10, wherein said light fraction is substantially free of dimethylbutanes.

12. The process recited in claim 1, wherein said large pore zeolite comprises zeolite and platinum.

13. The process recited in claim 12, wherein said light fraction comprises a $C_7$+ fraction.

14. A process for reforming a hydrocarbon feed comprising:

(a) separating said hydrocarbon feed into a first fraction comprising $C_5$– hydrocarbons and dimethylbutanes and a second fraction comprising $C_6$+ hydrocarbons.

(b) separating said second fraction into (i) a light fraction comprising not more than about 10% by volume dimethylbutanes, said light fraction being selected from the group consisting of a $C_6$ fraction, a $C_7$ fraction, a $C_8$ fraction, a $C_6$–$C_7$ fraction, a $C_7$–$C_8$ fraction, a $C_6$–$C_8$ fraction, and a fraction consisting essentially of $C_6$ and $C_8$ hydrocarbons; and (ii) a heavy fraction; and (c) reforming said light fraction under reforming conditions in the presence of a monofunctional catalyst.

15. The process recited in claim 14, wherein said first fraction is a $C_6$– fraction, and said second fraction is a $C_7$+ fraction, step (b) comprising: separating said second fraction into (i) a light fraction comprising not more than about 10% by volume dimethylbutanes, said light fraction being selected from a $C_7$ fraction, a $C_8$ fraction, and a $C_7$–$C_8$ fraction, and (ii) a heavy fraction.

16. The process recited in claim 14, wherein said light fraction comprises not more than about 3% by volume dimethylbutanes.

17. The process recited in claim 14, wherein said light fraction is substantially free of dimethylbutanes.

18. A process recited in claim 14, in which the light fraction is a $C_6$ fraction and contains no more than about 1% by volume dimethylbutanes.

19. The process recited in claim 14, wherein said monofunctional catalyst comprises a large pore zeolite and at least one Group VIII metal.

20. The process recited in claim 19, where said large pore zeolite is zeolite L, and said Group VIII metal is platinum.

21. The process recited in claim 20, wherein said zeolite L further comprises a metal selected from the group consisting of magnesium, cesium, calcium, barium, strontium, zinc, nickel, manganese, cobalt, copper, and lead.

22. The process recited in claim 14, wherein said hydrocarbon feed is a $C_6$–$C_{11}$ fraction.

23. The process recited in claim 14, further comprising reforming said heavy fraction under reforming conditions in the presence of a bifunctional catalyst.

24. The process recited in claim 23, wherein said bifunctional catalyst comprises a Group VIII metal and a metal oxide support provided with acidic sites.

25. The process recited in claim 24, wherein said metal oxide support is alumina, and the Group VIII metal of said bifunctional catalyst is platinum.

26. The process recited in claim 25, wherein the bifunctional catalyst further comprises at least one promoter metal selected from rhenium, tin, germanium, iridium, tungsten, cobalt, rhodium, and nickel.

27. A process for reforming a hydrocarbon feedstock, comprising (a) separating said hydrocarbon feedstock into (i) a first fraction comprising $C_{5-}$ hydrocarbons and at least 75% of such dimethylbutanes as initially existed in said feedstock;

(ii) a light fraction comprising not more than about 10% by volume dimethylbutanes and less than 10% of such $C_{5-}$ hydrocarbons as initially existed in said feedstock; said light fraction being selected from the group consisting of a $C_6$, a $C_{6-7}$, a $C_7$, a $C_8$, a $C_{7-8}$, and a $C_{6-8}$, fraction; and (iii) a heavy fraction; and (b) reforming said light fraction under reforming conditions with a monofunctional large pore zeolite catalyst.

28. The process of claim 27, wherein said first fraction, apart from its dimethylbutane content, contains less than 5% by volume of other $C_6$ hydrocarbons.

* * * * *